US011420857B2

(12) United States Patent
Meijer

(10) Patent No.: US 11,420,857 B2
(45) Date of Patent: Aug. 23, 2022

(54) FORK ADJUSTER FOR A FORKLIFT TRUCK, FORKLIFT TRUCK PROVIDED THEREWITH AND METHOD FOR ADJUSTING FORKS

(71) Applicant: Meijer Holding B.V., Sint Jacobiparochie (NL)

(72) Inventor: Hendrik Meijer, Sint Jacobiparochie (NL)

(73) Assignee: Meijer Holding B.V., Sint Jacobiparochie (NL)

( * ) Notice: Subject to any disclaimer, the term of this patent is extended or adjusted under 35 U.S.C. 154(b) by 0 days.

(21) Appl. No.: 17/289,385

(22) PCT Filed: Nov. 19, 2019

(86) PCT No.: PCT/NL2019/050755

§ 371 (c)(1),
(2) Date: Apr. 28, 2021

(87) PCT Pub. No.: WO2020/106140

PCT Pub. Date: May 28, 2020

(65) Prior Publication Data

US 2021/0395060 A1 Dec. 23, 2021

(30) Foreign Application Priority Data

Nov. 19, 2018 (NL) ..... 2022025

(51) Int. Cl.

| | |
|---|---|
| ***B66F 9/14*** | (2006.01) |
| ***B66F 9/075*** | (2006.01) |
| ***B66F 9/19*** | (2006.01) |

(52) U.S. Cl.
CPC ..... *B66F 9/143* (2013.01); *B66F 9/0755* (2013.01); *B66F 9/07581* (2013.01); *B66F 9/195* (2013.01)

(58) Field of Classification Search
CPC .... B66F 9/143; B66F 9/0755; B66F 9/07581; B66F 9/195; B66F 9/14; B66F 9/141; B66F 9/142; B66F 9/144; B66F 9/146
See application file for complete search history.

(56) References Cited

U.S. PATENT DOCUMENTS 2,468,055 A * 4/1949 Gibler ..... B66F 9/12 414/528
4,381,166 A * 4/1983 Smart ..... B66F 9/143 414/667

(Continued)

FOREIGN PATENT DOCUMENTS

| | | |
|---|---|---|
| EP | 1447376 | 8/2004 |
| EP | 2816001 | 12/2014 |
| GB | 2460326 | 12/2009 |

*Primary Examiner* — Mark C Hageman
(74) *Attorney, Agent, or Firm* — Marcus C. Dawes

(57) ABSTRACT

The invention relates to a fork adjuster, forklift truck provided therewith and method for adjusting forks. The fork adjuster according to the invention comprises: a frame provided with coupling means configured to operatively couple the fork adjuster to the forklift truck; an adjusting mechanism arranged in or on the frame and configured to adjust the forks; a drive mechanism which can be connected operatively to the adjusting mechanism for driving the adjusting mechanism, wherein the drive mechanism is provided with contact means such that the adjusting mechanism is driveable by contact of the contact means with a ground surface.

17 Claims, 5 Drawing Sheets

(56) References Cited

U.S. PATENT DOCUMENTS

| | | | | | |
|---|---|---|---|---|---|
| 4,688,982 | A * | 8/1987 | Smart | B66F 9/065 | |
| | | | | 414/667 | |
| 5,336,039 | A * | 8/1994 | House | B66F 9/143 | |
| | | | | 294/119.1 | |
| 7,165,652 | B2 * | 1/2007 | Allerding | B66F 9/0755 | |
| | | | | 187/224 | |
| 9,745,180 | B2 * | 8/2017 | Meijer | B66F 9/12 | |
| 10,167,180 | B2 * | 1/2019 | Kent | B66F 9/143 | |
| 2016/0207747 | A1 | 7/2016 | Kent | | |
| 2021/0354965 | A1 * | 11/2021 | Matti | B66F 9/143 | |

* cited by examiner

FORK ADJUSTER FOR A FORKLIFT TRUCK, FORKLIFT TRUCK PROVIDED THEREWITH AND METHOD FOR ADJUSTING FORKS

The invention relates to a fork adjuster for a forklift truck.

In practice many goods are transported and stored on pallets or other similar carriers. Dimensions of such pallets vary. Most pallets are provided here with different lengths and widths. This means that it can be advantageous to adapt the position of the forks to dimensions of a pallet to be taken up and/or the side from which a pallet must be taken up. Known in practice are fork adjusters which are suitable for adjusting the mutual distance between the forks. Such fork adjusters can for instance be displaced relative to a frame manually. It is also possible to perform the adjustment using hydraulic cylinders which can be driven from the forklift truck. In this way the adjustment can take place in automated manner Manual adjustment requires manual action by for instance the forklift truck driver. This takes time. There is further a risk of the adjustment not being implemented consistently, which may result in a pallet being taken up with incorrectly adjusted forks. This can even result in damage to persons and/or goods. The use of hydraulic cylinders requires additional equipment, wherein the fork adjuster must be operatively connected to an external drive, such as the hydraulic system of the forklift truck. This requires additional assembly operations. In addition, this makes additional demands of the hydraulic system of the forklift truck. This additionally increases the risk of failure and requires additional maintenance.

The present invention has for its object to provide a fork adjuster for a forklift truck whereby the above stated problems are obviated or at least reduced.

This object is achieved with the fork adjuster for a forklift truck according to the invention, wherein the fork adjuster comprises:

- a frame provided with coupling means configured to operatively couple the fork adjuster to the forklift truck;
- an adjusting mechanism arranged in or on the frame and configured to adjust the forks;
- a drive mechanism which can be connected operatively to the adjusting mechanism for driving the adjusting mechanism, wherein the drive mechanism is provided with contact means such that the adjusting mechanism is driveable by contact of the contact means with a ground surface.

According to the invention, the frame of the fork adjuster can be arranged on a forklift truck by means of coupling means. These coupling means are for instance hooks, bolts or other couplings. The coupling means are preferably provided such that the fork adjuster can be mounted releasably on a forklift truck.

By providing the frame of the fork adjuster with an adjusting mechanism the forks can be displaced relative to the frame. A drive mechanism provides for the actual adjustment or displacement of the forks relative to the frame. According to the invention, the drive mechanism is here provided with contact means which are embodied such that the adjusting mechanism can be driven by bringing the contact means into contact with a ground surface. Such a ground surface is for instance the floor of a distribution centre.

By providing the adjusting mechanism drivably on the basis of the contact between the contact means and the ground surface, the adjustment of the forks can be performed by means of displacement of the forklift truck over this ground surface. The forklift truck can here be moved forward or rearward, whereby the forks can move laterally relative to the frame by means of the drive mechanism. This results in a robust (mechanical) adjusting mechanism with a limited number of components and a greatly reduced susceptibility to malfunction. It is further not necessary to arrange any cabling between the fork adjuster and the forklift truck, wherein it is particularly hydraulic connections which do not have to be arranged. The fork adjuster therefore operates autonomously relative to the forklift truck, while a user-friendly adjustment is still possible, and wherein a forklift truck driver can remain in the cab if desired. A further advantage of the fork adjuster according to the invention is that the fork adjuster can also be mounted on conventional forklift trucks in relatively simple manner The adjusting mechanism is preferably driveable without a canting or tipping movement being required. This makes the adjustment easily applicable in practice for a driver of a forklift truck. Alternatively, it is also possible to use a small tilting angle of up to for instance 2 degrees for adjusting the forks. The contact surface with the ground surface is hereby limited, yet it is not necessary to perform a large canting or tilting movement wherein forks point upward. This is awkward for the driver and can additionally form a safety risk.

Although the above described fork adjuster is described in combination with a forklift truck, it will be apparent to the skilled person that a forklift truck is also understood to mean a so-called AGV or other devices provided with forks. If desired, it is possible to (optionally additionally) provide the drive mechanism with an electric motor. Although this does increase the number of components, it is here also possible, if desired, to provide an autonomously operating fork adjuster. In a currently preferred embodiment of the fork adjuster according to the invention it operates wholly mechanically and autonomously from the forklift truck.

With the fork adjuster according to the invention it is possible to adjust the mutual distance between the forks and adapt it to for instance a pallet to be picked up. The forks are for this purpose moved toward each other or away from each other, preferably by bringing the contact means in the form of a wheel, for instance a running wheel, into contact with the ground surface for the purpose of the adjustment. If desired, it is also possible to displace the forks laterally collectively in similar manner, whereby a so-called sideshift mechanism is obtained. The forks are here displaced relative to the frame collectively at the same mutual distance. The forks can hereby for instance be aligned relative to the pallet to be picked up.

In currently preferred embodiment the contact means, for instance in the form of a running wheel, can be brought into contact with a ground surface manually or automatically by a user. By then moving the forklift truck forward or rearward the adjusting mechanism will displace the forks by means of the contact means, and herein for instance change the mutual distance of the forks in accordance with the pallet to be picked up. By preferably already performing such an adjustment when driving toward the pallet, no additional operations or movements of the driver, user or forklift truck are necessary. This means that the forks are adjustable, and can be adapted in respect of their position to a pallet to be picked up, in effective and efficient manner The contact means preferably comprise one or more wheels or rollers. Applying such wheels or rollers enables a direct transmission between a wheel, or other suitable contact means, and the adjusting mechanism. The transmission of the movement of these wheels or rollers can be performed by a direct or non-direct transmission.

In an advantageous embodiment according to the invention the adjusting mechanism is provided with at least one spindle.

By providing a spindle forks can be displaced by the fork adjuster in effective manner The spindle is for instance embodied as a so-called threaded spindle, for instance provided with trapezoidal thread or a ball or runner spindle. If the mutual distance between two forks has to be adjusted with the fork adjuster, such a threaded spindle can for instance be provided with a left-hand and right-hand screw thread. In a currently preferred embodiment two bushes are mounted round the spindle, one for the left-hand thread and one for the right-hand thread, for the individual forks. The spindle can rotate inside the frame as a result of the movement of the contact means, for instance a wheel or roller.

It is noted that providing the same thread on the left and right side instead of a different left-hand thread and right-hand thread enables a sideshift adjustment as already mentioned above. In a currently preferred embodiment the spindle is however provided with an opposite screw thread for adjusting the mutual distance between two adjacent forks.

In addition to the at least one spindle, the adjusting mechanism is preferably provided with an additional guide. This additional guide provides additional stability and robustness to the adjusting mechanism. Such an additional guide can be provided as a so-called slide shaft or alternatively as second spindle. In such an embodiment with a second spindle the two spindles are preferably connected to each other via a transmission in the form of toothed wheels, chains, a belt and the like. The combination of the two spindles hereby provides for the displacement of the forks. By bringing the contact means, for instance in the form of a running wheel or travelling roller, into contact with the ground surface this contact means can be set into rotation by movement of the forklift truck. This rotation is transmitted to the at least one spindle and, depending on the chosen embodiment, also via a transmission to the second shaft or spindle. An effective mechanism and autonomous adjustment of the forks is hereby made possible with the fork adjuster according to the invention.

In a currently preferred embodiment a spindle is provided in combination with a guide positioned thereabove, for instance in the form of a shaft. As alternative to a shaft, a guide with the fork in a slotted hole can also be provided along with the frame. This realizes a cost-effective embodiment of the guide in particular and the fork adjuster as a whole.

In a currently preferred embodiment the transmission is provided with a transmission ratio. Application of a suitable transmission ratio allows the movement of the forks to be chosen as optimally as possible in combination with a displacement distance of the forklift truck. The ratio between fork displacement and forklift truck displacement is preferably greater than 1, more preferably greater than 2, and still more preferably greater than 3. By applying such a transmission ratio an accurate adjustment of the forks can be realized. In a currently preferred embodiment forks are displaceable from minimal to maximal mutual distance by a forklift truck displacement of about 4.5-6 metres, preferably about 5 metres. This enables an accurate adjustment. Use is optionally made of a slip coupling between the contact means and the shaft along which the forks are displaceable. Undesired forces are hereby prevented from acting on the fork adjuster when the forks are in an extreme position. This prevents damage to and wear of the fork adjuster.

By preferably having the contact means, such as a running wheel, come into contact with the ground surface when the forks are in a substantially horizontal position on the ground surface a safe adjustment is here made possible, without the forks pointing upward. It is particularly the combination of an accurate and safe adjustment that enables an effective application in daily practice.

In an advantageous embodiment according to the invention the fork adjuster further comprises an activator configured to activate a drive mechanism.

By providing an activator the adjusting mechanism can be activated in effective manner, whereby the forks can be adapted to for instance a pallet to be picked up. The drive mechanism is here brought directly or indirectly into contact with the ground surface.

In a currently preferred embodiment the activator comprises a coupling with the tilting system of a forklift truck which is configured to tilt the forks backwards. This tilting backwards enables the contact means, for instance a running wheel, to be brought into contact with the ground surface, and thereby the forks to be adjusted using the adjusting mechanism.

In an alternative preferred embodiment the activator comprises a gear transmission for forming a non-direct transmission between the contact means and the adjusting mechanism. A gear transmission, or alternatively a chain or belt or the like, can here provide for the coupling between the contact means and the adjusting mechanism by means of the activator if an adjustment of the forks is desired. This is for instance possible by bringing a toothed wheel into engagement with the contact means and the adjusting mechanism. In a possible embodiment the gear transmission is applied in combination with the tilting system. The tilting backwards enables a contact means, for instance in the form of a running wheel, to be coupled via the gear transmission to the adjusting mechanism. An effective and efficient adjustment of the forks becomes possible hereby.

A slip coupling is optionally provided between the drive/transmission, such as a gear transmission, and the contact means, such as a running wheel. Undesired forces on the mechanism are hereby prevented, for instance when the forks are in the extreme position.

In a further currently preferred embodiment the activator comprises a contact element which can be operated by a user. Such a contact element, for instance in the form of a lever, button and the like, enables the contact means to be actively coupled to the adjusting mechanism. It is possible to apply such a manually operated element as alternative to or in combination with the above stated tilting system.

It is further possible to provide the fork adjuster according to the invention with an activator comprising a remote control. Such a remote control can preferably connect the adjusting mechanism wirelessly to the contact means from the cab. This is for instance possible by making use of Bluetooth communication. Such an activator can for instance also be applied in the case of a so-called AGV.

In a further advantageous embodiment according to the invention the fork adjuster comprises a fork position sensor for measuring the position of at least one of the forks.

By providing a fork position sensor the position of the forks relative to the frame or other component of the forklift truck can be measured. It is also possible to determine the position in a space, for instance in a warehouse or distribution centre. Such a position sensor makes it possible to check the actual position of the forks. This is particularly advantageous in the case of automatic forklift trucks, for instance in the form of an AGV.

The invention further relates to a forklift truck provided with a fork adjuster as described herein.

Such a forklift truck provides similar effects and advantages as described for the fork adjuster. It is noted that a forklift truck is also understood to mean other equipment, particularly an AGV.

The invention further also relates to a method for adjusting the forks of a forklift truck, the method comprising of:

providing a fork adjuster for a forklift truck in an embodiment according to the invention; and adjusting the forks.

The method provides similar effects and advantages as described for the fork adjuster and/or the forklift truck.

By performing the adjustment of the forks by means of contact means, for instance a running wheel, and here bringing them into contact with a ground surface the position of the forks can be adjusted using the movement of the forklift truck. This results in an effective and efficient adjustment. It is also possible here to already perform the adjustment when driving toward the pallet to be picked up, such that no additional operations are needed for the adjustment. It will be apparent that this increases the overall efficiency and effectiveness of the transport.

Further advantages, features and details of the invention are elucidated on the basis of preferred embodiments thereof, wherein reference is made to the accompanying drawings, in which.

Figure 3A:
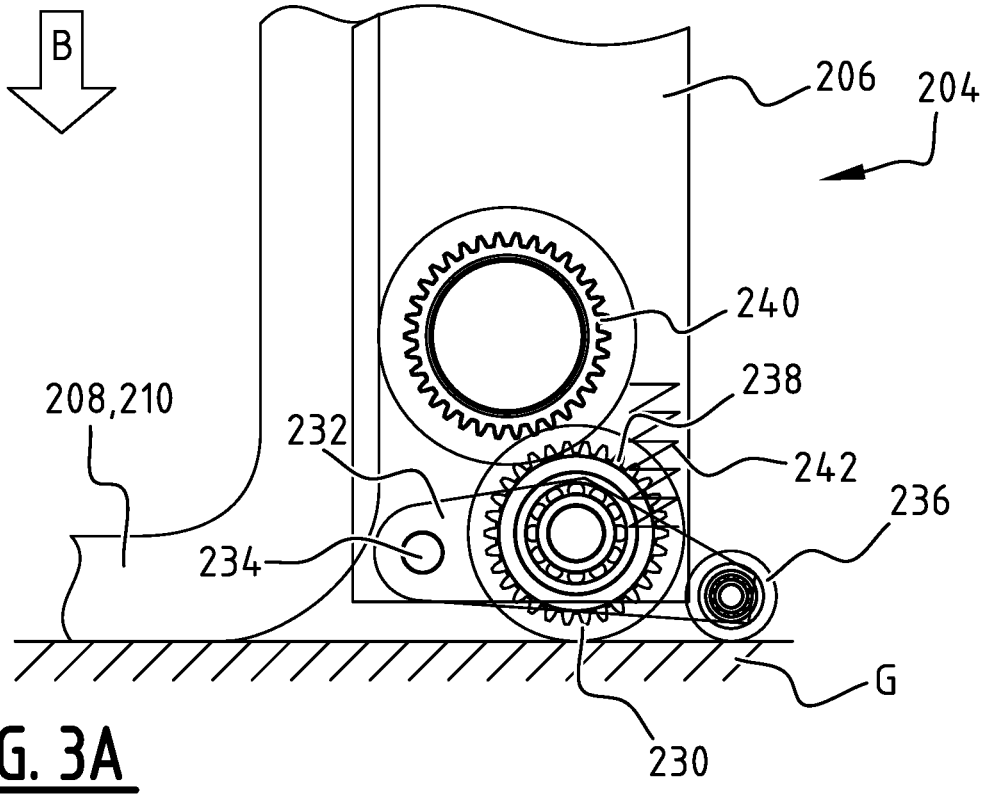
Figure 3B:
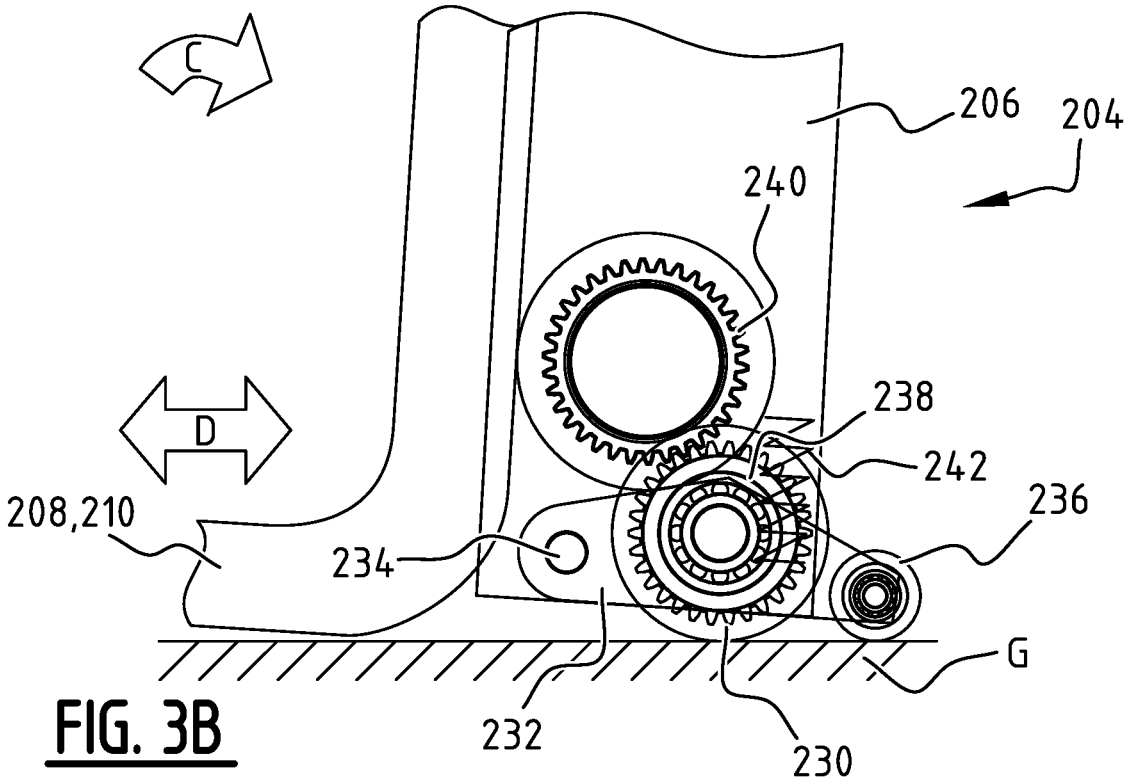
Figure 4:
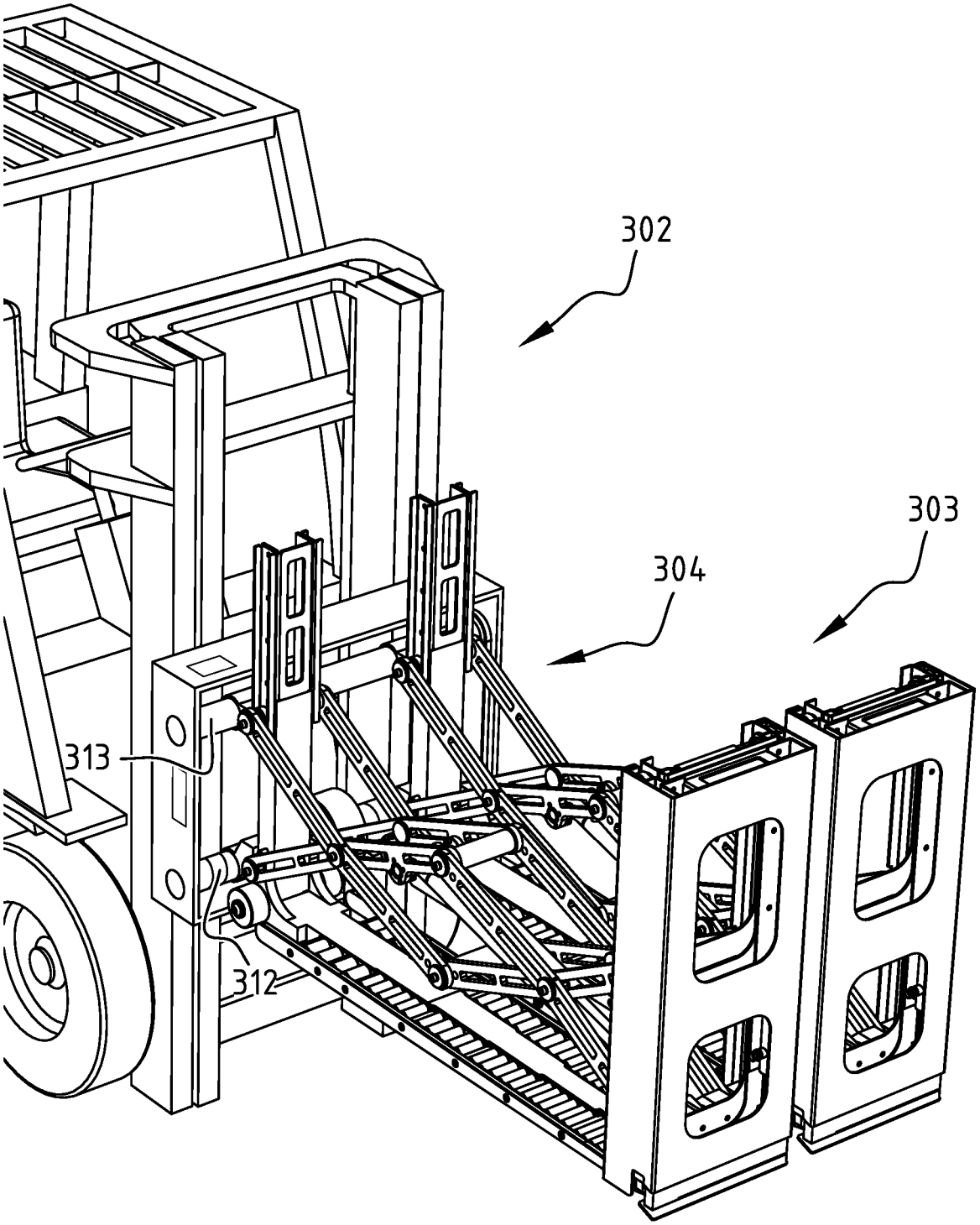

FIG. 3A-B show views of a fork adjuster according to the invention with additional transmission;

FIG. 4 shows a forklift truck provided with a push-pull system; and

Figure 1:
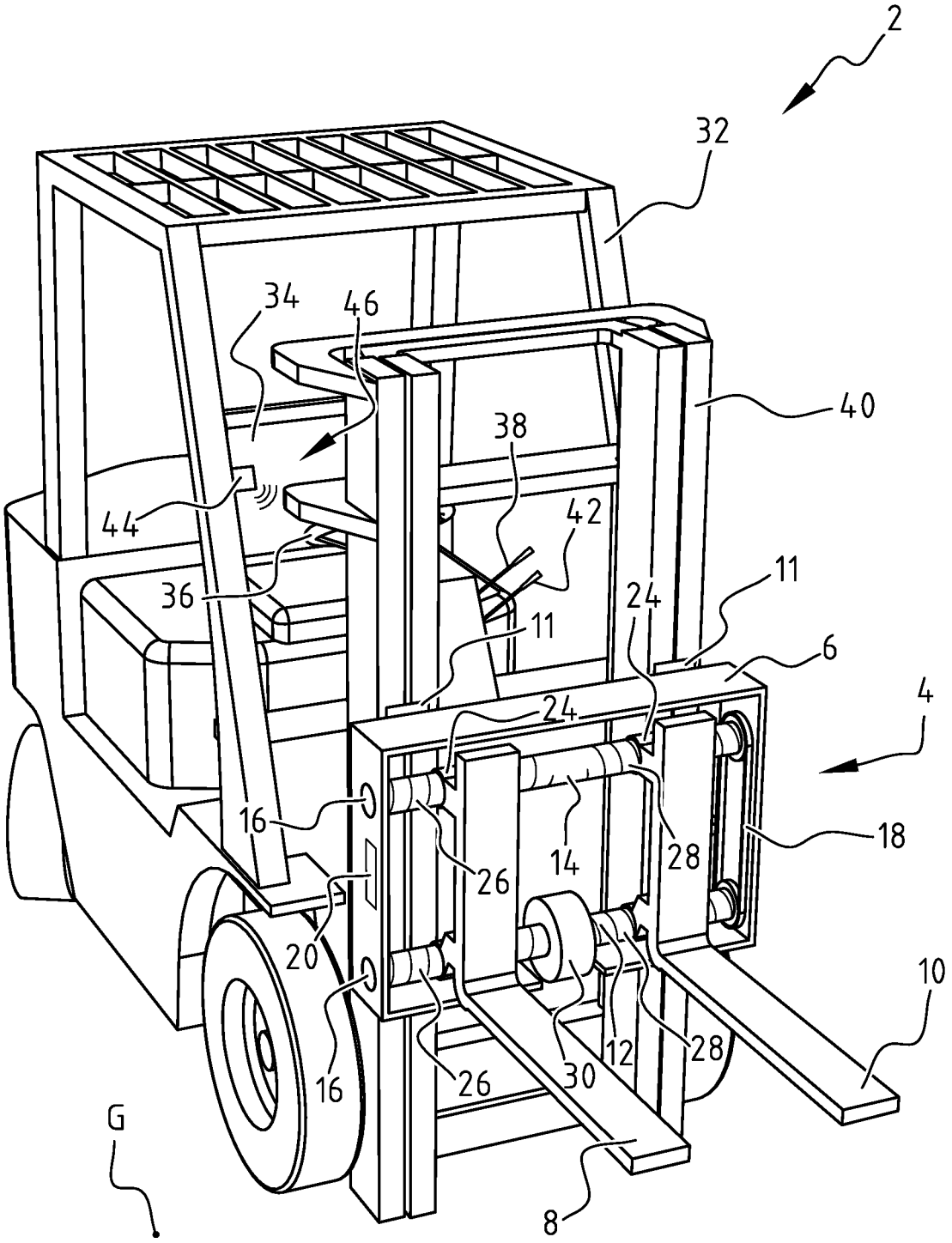
FIG. 1 shows a view of a forklift truck provided with a fork adjuster according to the invention.
Figure 5A:
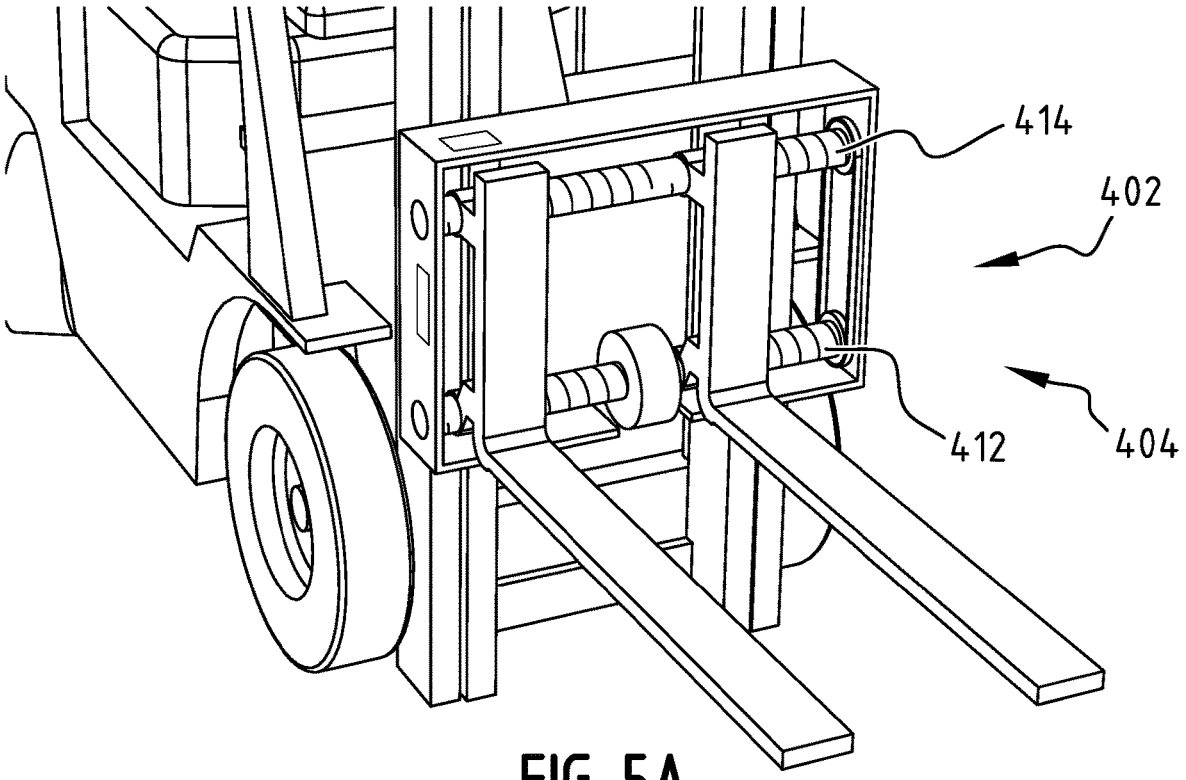
Figure 5B:
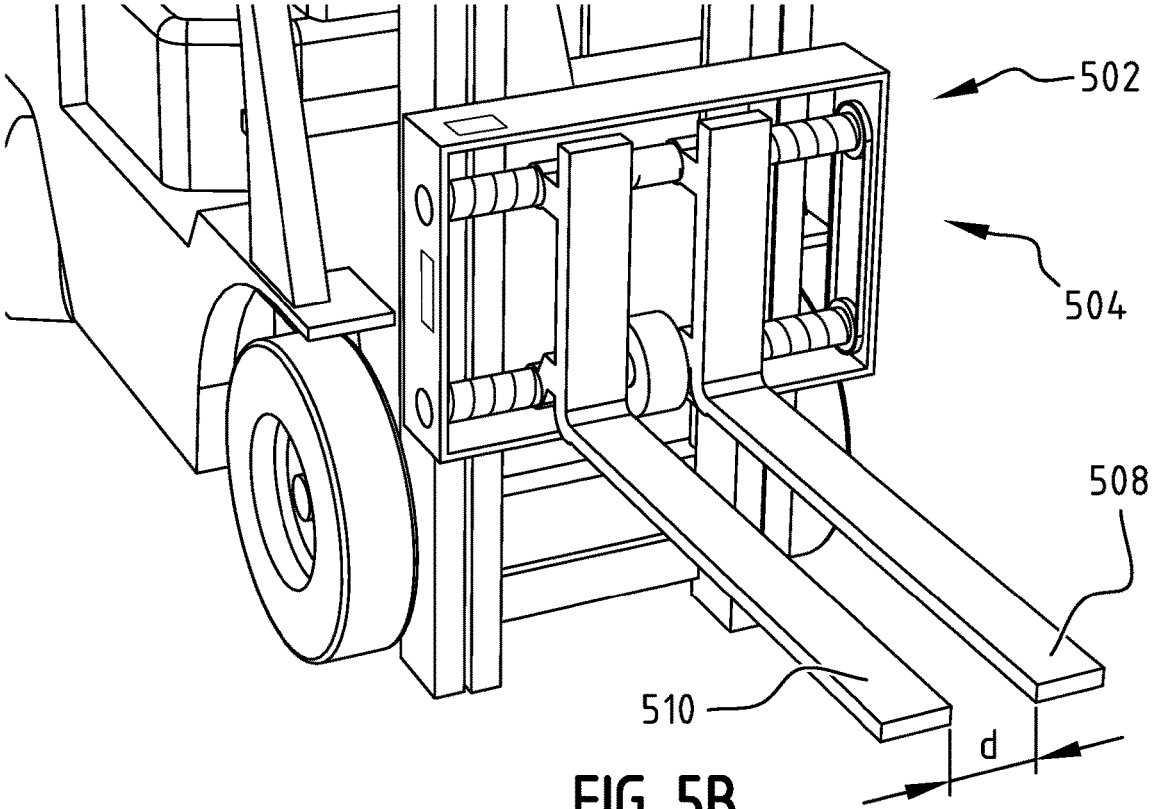

FIG. 5A-B shows the forklift truck of FIG. 1, wherein the fork adjuster is embodied as a sideshift mechanism (FIG. 5A) and fork adjustment (FIG. 5B).

Forklift truck 2 (FIG. 1) is provided with fork adjuster 4. In the shown embodiment fork adjuster 4 is provided with frame 6 on which two forks 8, 10 can be arranged. Frame 6 can be connected via coupling 11 (shown schematically) to forklift truck 2. Frame 6 is further provided with a first spindle 12 and second shaft/spindle 14 which are arranged rotatably in frame 6 in suspension or bearing 16. In the shown embodiment spindles 12, 14 are mutually connected via drive 18, embodied as a belt in the shown embodiment.

In the shown embodiment turns of one or more spindles 12, 14 are measured using schematically shown fork position sensor 20 (FIG. 1), whereby the position of forks 8, 10 is known. Using bushes 24, forks 8, 10 are movable along shafts/spindles 12, 14, wherein these are in a preferred embodiment provided with first thread 26 and second, opposite thread 28. Running wheel 30 is operatively connected as contact means to spindle 12. Running wheel 30 can be placed on ground surface G, whereby spindle 12 will rotate. In the shown embodiment the rotation of spindle 12 will be transmitted via transmission 18 to spindle/shaft 14. This provides for movement of bushes 24 and thereby adjustment of forks 8, 10, whereby in this shown embodiment the mutual distance of forks 8, 10 is reduced or is conversely increased.

In the shown embodiment forklift truck 2 is provided with cab 32 (FIG. 1) with seat 34 and steering wheel 36. Tilting system 38 makes it possible to incline mast 40 forward and rearward and thereby for instance bring running wheel 30 into contact with ground surface G. In additional or alternative manner it is possible to provide operating handle 42 with which running wheel 30 is operatively connected via a mechanical connection (for instance a gear connection) to spindle 12. Alternatively or additionally, a (Bluetooth) signal 46 with which activation is carried out can be generated using transmitter 44.

Figure 2:
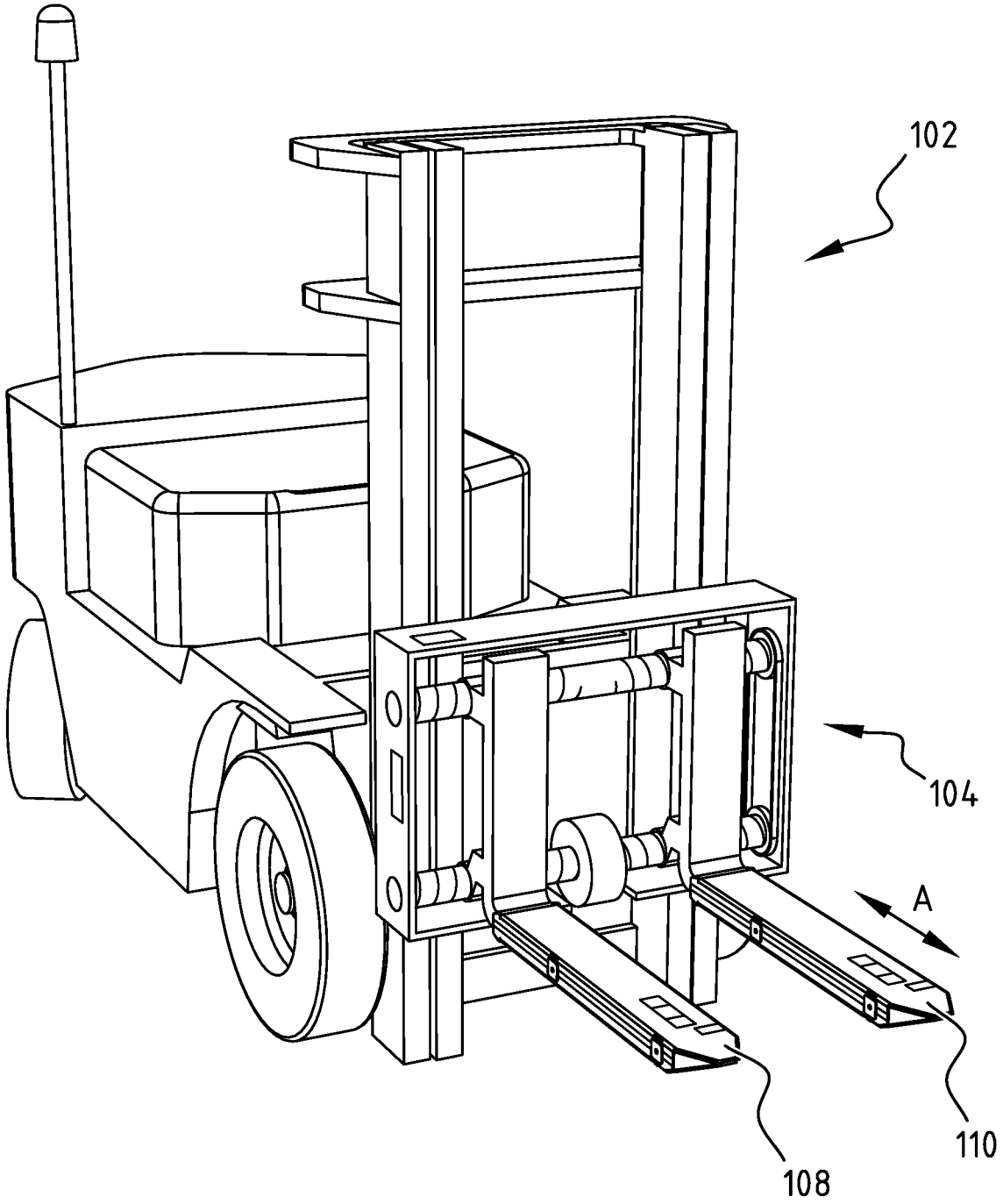
FIG. 2 shows a view of an AGV provided with a fork adjuster according to the invention, wherein the forks are embodied as outward slidable (extending) forks.

In an alternative embodiment AGV 102 (FIG. 2) is provided with fork adjuster 104. In this embodiment forks 108, 110 are embodied as so-called extending forks which are outward slidable in direction A. It will be apparent that forks 8, 10 and extending forks 108, 110 are interchangeable and can both be used on forklift truck 2 and/or AGV 102.

Fork adjuster 204 (FIG. 3A-B) is provided with running wheel 230 which runs over ground surface G. In the shown embodiment running wheel 230 is arranged on arm 232 which is provided using shaft 234 on frame 206 of fork adjuster 204. Arm 232 is provided on the other side with support wheel 236.

In the normal position, with a fork adjuster 204 moved in downward direction B, running wheel 230 will co-rotate when forks 208, 210 move over ground surface G. In the shown uncoupled embodiment (FIG. 3A) running wheel 230 is in such a position not operatively connected to spindle 212 because toothed wheels 238, 240 are not in engagement. In this shown embodiment optional spring mechanism 242 provides for a mutual distance between toothed wheels 238, 240.

By moving forks 208, 210 from the "straight" position in direction C to a position in a tilting position (FIG. 3B) toothed wheel 238 will be brought into engagement with toothed wheel 240 counter to the spring action of spring 242. Running wheel 230 is hereby connected operatively to spindle 212 arranged in frame 206. The adjustment of forks 208, 210 can hereby be realized in effective manner It will be apparent that in this shown embodiment the forward movement or rearward movement in direction D of running wheel 230 realizes an opposite adjustment of forks 208, 210. If desired, it is also possible to dispense with spring 242.

In an alternative embodiment forklift truck 302 (FIG. 4) is provided with push-pull system 303 with an adjustment allowed by adjuster 304. Provided in this shown embodiment is a first spindle shaft 312 and a second slide shaft 313. It will be apparent that such a slide shaft 313 can also be applied in other embodiments, such as forklift truck 2 and/or AGV 102.

A further alternative embodiment shows forklift truck 402 provided with adjusting mechanism 404 (FIG. 5A), wherein thread on spindles 412, 414 is the same on the left-hand and right-hand side, whereby a sideshift mechanism is obtained. It will be apparent that such a sideshift mechanism can also be realized with other shown embodiments for the forklift truck 2, 102, 302.

In the case that forklift truck 502 (FIG. 5B) is provided with fork adjuster 504 the mutual distance d between forks 508, 510 can be adjusted when driving toward a pallet. Using for instance tilting system 38 (FIG. 1) drive wheel 30, 230 can be brought into contact with the ground surface G such that spindle 12, 212 is driven hereby, whereby forks 8, 10, 108, 110, 208, 210, 508, 510 are adjusted. It is possible here to have forks move toward each other when driving forward or move apart when moving rearward, or conversely vice versa. It is also possible to provide the movement as sideshift movement (FIG. 5A).

The present invention is by no means limited to the above described preferred embodiments thereof. The rights sought are defined by the following claims, within the scope of which many modifications can be envisaged.

The invention claimed is:

1. A fork adjuster for a forklift truck, comprising:

a frame provided with coupling means configured to operatively couple the fork adjuster to the forklift truck;

an adjusting mechanism arranged in or on the frame and configured to adjust the forks;

a drive mechanism comprising a contact means which can be connected operatively to the adjusting mechanism for driving the adjusting mechanism;

a slip coupling disposed between the drive mechanism and the adjusting mechanism; and a transmission ratio defined by a displacement distance of the forklift truck to a displacement distance of the forks, wherein the transmission ratio is at least 1, wherein the adjusting mechanism is configured to be driven by contact of the contact means with a ground surface.

2. The fork adjuster according to claim 1, wherein the contact means comprises one or more wheels or rollers.

3. The fork adjuster according to claim 1, wherein the adjusting mechanism is comprises at least one spindle.

4. The fork adjuster according to claim 3, wherein the at least one spindle comprises an opposite screw thread for adjacent forks.

5. The fork adjuster according to claim 3, wherein the adjusting mechanism comprises guide.

6. The fork adjuster according to claim 5, wherein the guide is a spindle.

7. The fork adjuster according to claim 1, wherein the transmission ratio is defined by a displacement distance of the forks to a displacement distance and the forklift truck, wherein the transmission ratio is at least 2.

8. The fork adjuster according to claim 1, further comprising an activator configured to activate the drive mechanism.

9. The fork adjuster according to claim 8, wherein the activator comprises a coupling with a tilting system configured to tilt the forks backwards.

10. The fork adjuster according to claim 8, further comprising a gear transmission for forming a non-direct transmission between the contact means and the adjusting mechanism.

11. The fork adjuster according to claim 8, wherein the activator comprises an operating handle which can be operated by a user.

12. The fork adjuster according to claim 8, wherein the activator comprises a remote control.

13. The fork adjuster according to claim 1, further comprising a fork position sensor for measuring the position of at least one of the forks.

14. The fork adjuster according to claim 1, wherein the forks comprise extendable forks.

15. A forklift truck provided with a fork adjuster comprising:

a frame provided with coupling means configured to operatively couple the fork adjuster to the forklift truck;

an adjusting mechanism arranged in or on the frame and configured to adjust the forks;

a drive mechanism comprising a contact means which can be connected operatively to the adjusting mechanism for driving the adjusting mechanism;

a slip coupling disposed between the drive mechanism and the adjusting mechanism; and a transmission ratio defined by a displacement distance of the forklift truck to a displacement distance of the forks, wherein the transmission ratio is at least 1, wherein the adjusting mechanism is configured to be driven by contact of the contact means with a ground surface.

16. The forklift truck according to claim 15, wherein the contact means comprises one or more wheels or rollers and wherein the adjusting mechanism comprises at least one spindle.

17. A method for adjusting forks of a forklift truck, comprising of:

providing a fork adjuster for a forklift truck with the forklift truck comprising:

a frame provided with coupling means configured to operatively couple the fork adjuster to the forklift truck;

an adjusting mechanism arranged in or on the frame and configured to adjust the forks; and a drive mechanism comprising a contact means which can be connected operatively to the adjusting mechanism for driving the adjusting mechanism;

a slip coupling disposed between the drive mechanism and the adjusting mechanism; and a transmission ratio defined by a displacement distance of the forklift truck to a displacement distance of the forks, wherein the transmission ratio is at least 1, wherein the adjusting mechanism is configured to be driven by contact of the contact means with a ground surface; and adjusting the forks.

* * * * *